United States Patent [19]

Gallucci

[11] Patent Number: 4,979,655

[45] Date of Patent: Dec. 25, 1990

[54] POURING FITMENT

[76] Inventor: Daniel D. Gallucci, 1523 N. Beverly Glen, Bel Air, Calif. 90077

[21] Appl. No.: 394,222

[22] Filed: Aug. 14, 1989

Related U.S. Application Data

[63] Continuation-in-part of Ser. No. 190,641, May 5, 1988, abandoned.

[51] Int. Cl.[5] ..... B65D 47/00

[52] U.S. Cl. ..... 222/519; 222/548; 222/549; 141/332

[58] Field of Search ..... 222/478, 484–485, 222/513–514, 519, 548–549; 141/332, 333–337, 331, 345; 220/85 SP

[56] References Cited

U.S. PATENT DOCUMENTS

| | | | |
|---|---|---|---|
| 171,269 | 12/1875 | Cross | 141/337 |
| 478,303 | 7/1892 | Allgood | 141/332 X |
| 920,373 | 5/1909 | Coons | 222/519 |
| 1,023,735 | 4/1912 | Hager | 222/519 |
| 1,361,290 | 12/1920 | Spruill | 222/519 X |
| 1,750,205 | 3/1930 | Willumsen | 222/514 |
| 1,862,973 | 12/1930 | McDonald | 222/519 |
| 1,912,304 | 4/1930 | Phillips | 222/524 |
| 2,165,825 | 1/1935 | Von Bultzingslowen | 222/519 |
| 2,597,165 | 10/1947 | Minturn | 222/513 |
| 2,851,202 | 3/1956 | Bradbury | 222/505 |
| 3,357,605 | 12/1967 | Chadfield | 222/485 |
| 3,690,520 | 9/1972 | Sarris | 222/499 |
| 3,915,359 | 10/1975 | Feldman | 222/514 |
| 4,232,716 | 11/1980 | White | 141/98 |
| 4,544,063 | 10/1985 | Neward | 206/540 |
| 4,834,151 | 5/1989 | Law | 141/98 |
| 4,846,380 | 7/1989 | Giuseppe | 222/519 |

FOREIGN PATENT DOCUMENTS 515688 2/1955 Italy .

*Primary Examiner*—Michael S. Huppert
*Attorney, Agent, or Firm*—Brown, Martin, Haller & McClain

[57] ABSTRACT

A pouring assembly or fitment for pouring material from a container in an inverted position comprises a tube having a first end for attachment to the open end of the container and a second end having a dispensing opening for dispensing material from the tube, and a closure sleeve fitting over the second end of the tube and movable relative to the tube between a first position in which the dispensing opening is blocked and a second position in which the dispensing opening is open. The closure sleeve has a closed first end, a cylindrical portion extending from the first end for closely fitting over the second end of the tube, and an outwardly tapering conical portion extending from the cylindrical portion to the second end of the sleeve, which acts as a rest for positioning the assembly on oil fill openings of varying dimensions.

14 Claims, 2 Drawing Sheets

POURING FITMENT

CROSS-REFERENCE TO RELATED APPLICATIONS

This application is a continuation-in-part of Application Ser. No. 07/190,641 filed May 5, 1988 now abandoned.

BACKGROUND OF THE INVENTION

The present invention relates generally to pouring spouts or fitments for dispensing materials from containers or packages, and is particularly directed to a pouring spout for controlling pouring of material from a container in an inverted position, for example for delivery of oil to the oil tank of the engines of automobiles, aircraft or other machinery.

The accurate delivery of oil to the inlet of vehicle or other engine oil tanks is difficult to achieve in practice, in view of the complexity of modern automobile engines which often place the oil tank inlet in an awkward position. Spilling or dripping of oil onto adjacent engine parts is often difficult or impossible to avoid, fouling the engine.

Some pouring spouts have been proposed in the past which have to some extent addressed this problem. However, these have generally been bulky, complex, and relatively difficult to use, often requiring two handed operation, which is difficult when leaning over an engine.

SUMMARY OF THE INVENTION

It is an object of the present invention to provide an improved pouring spout or fitment for controlling dispensing of materials from a container in an inverted position.

According to the present invention a pouring spout assembly is provided which comprises an elongate pouring tube having a first end for attachment to the mouth of a container and a second, opposite end portion having at least one dispensing opening for dispensing material from the tube, and a closure sleeve for fitting over the second end of the tube, the closure sleeve having a first, cylindrical portion which is a close fit over a portion of the pouring tube extending from its second end, and a second, conical portion which is continuously tapered gradually outwardly from the cylindrical portion to an opposite end of the sleeve. The closure sleeve has at least one dispensing opening in its cylindrical portion, and is movable relative to the pouring tube between a first position in which the dispensing openings are blocked and a second position in which the dispensing openings are open to permit material to be dispensed from the assembly. A gripping portion is provided on the second, flared end of the sleeve for gripping by a user to move the sleeve back and forth between the two positions.

In one embodiment of the invention, the sleeve is rotatable relative to the tube between the first and second positions, and the dispensing openings on the sleeve and tube are displaced from one another in the first position and aligned in registry with one another in the second position. In a second embodiment of the invention, the dispensing opening on the tube is provided on the axial end of the tube and is closed in the first position by the corresponding closed axial end of the closure sleeve. In this version of the invention interengaging keying formations on the corresponding inner and outer faces of the sleeve and tube, respectively, cause axial movement of the sleeve on rotation of the sleeve relative to the tube, moving the sleeve axially outwardly to open the dispensing opening on the end of the tube. The dispensing opening on the sleeve is simultaneously opened by the axial movement of the sleeve, allowing material to be dispensed.

The gradually tapering conical portion of the sleeve allows inverted seating of the spout into oil reservoir openings in a wide variety of potential different sizes and configurations. Thus, the spout can be seated in its inverted position before moving the sleeve into the open position, allowing the spout to be opened easily using only one hand and completely closed once dispensing is complete and prior to removal of the spout from the oil fill opening, reducing or eliminating the risk of spillage and contamination of surrounding engine parts.

The pouring tube and closure sleeve may be molded of plastics material such as polyethylene or similar thermoplastic resins with an interference fit, so that no additional sealing gaskets will be necessary. This results in a simple and inexpensive product which is economical to manufacture.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
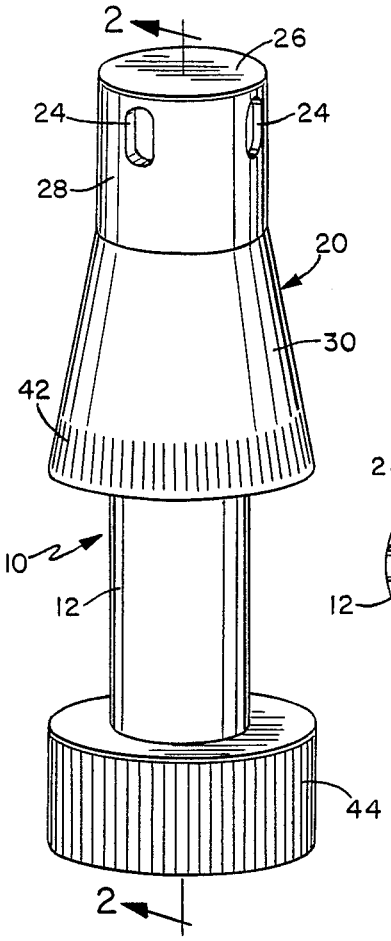
FIG. 1 is a perspective view of one configuration of the pouring spout.

FIGS. 1 to 5 of the drawings illustrate a first embodiment of the pouring spout 10 according to the invention. The spout or pouring assembly 10 basically comprises an inner pouring tube 12 having internal screw threads 14 at one end for fitting onto the open end of a container or bottle 18 from which material is to be dispensed, and an outer closure sleeve 20 fitting over the pouring tube 12 for controlling dispensing of material from the assembly.

The inner tube 12 has a series of spaced dispensing openings or slots 22 adjacent its end 23 opposite to threaded end 14, and the closure sleeve has a corresponding series of equally spaced slots 24 adjacent its closed end 26 which engages the end 23 when the sleeve is fitted over the tube. The sleeve has a first, cylindrical end portion 28 extending from its closed end 26 which is a close fit over the underlying portions of the tube, as best illustrated in FIG. 2, and a second, conical portion 30 which tapers gradually outwardly from the cylindrical portion to the opposite end 32 of the sleeve.

Figure 3:
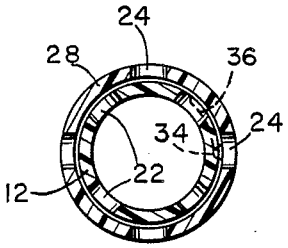
FIG. 3 is a sectional view taken on line 3—3 of FIG. 2.
Figure 2:
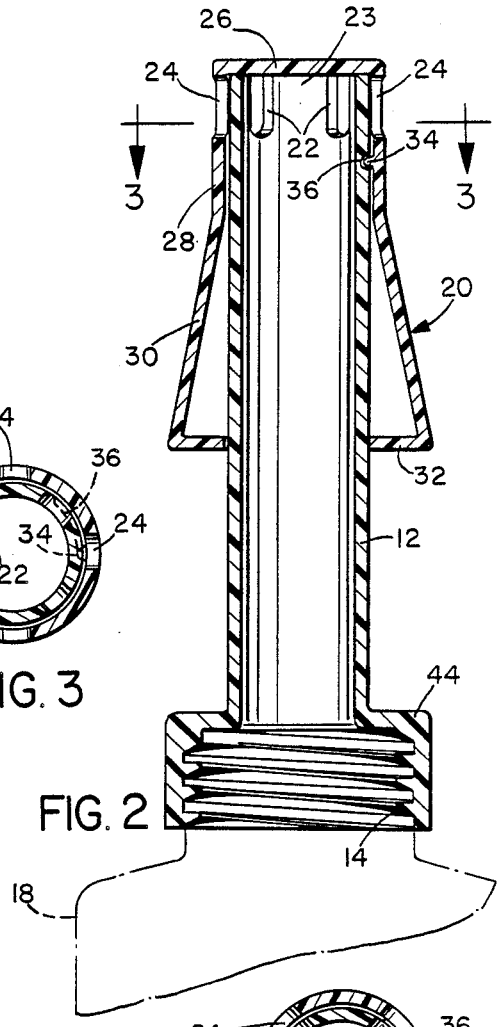
FIG. 2 is a sectional view taken on line 2—2 of FIG. 1, with the spout closed.
Figure 4:
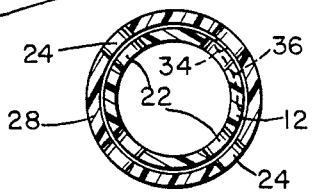
FIG. 4 is a view similar to FIG. 3, but with the spout opened.
Figure 5:
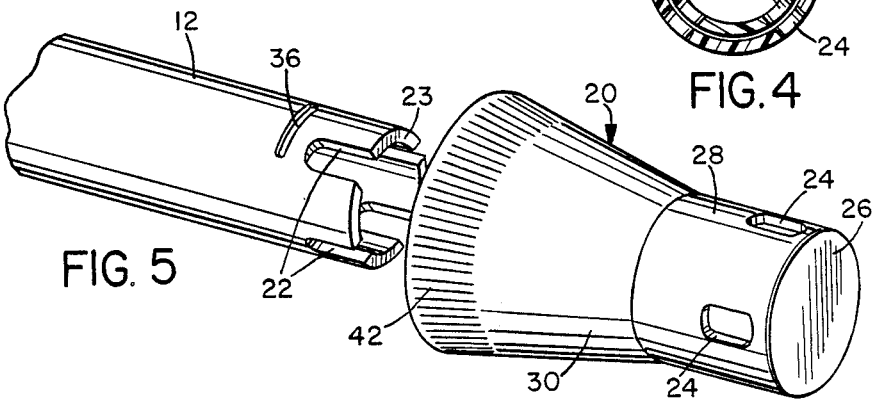
FIG. 5 is a perspective view of the two spout components separated.

The sleeve is rotatably mounted on the tube, the rotation being limited by means of a projection 34 on the inner surface of the sleeve which engages in an elongated detent or groove 36 extending around part of the outer circumference of the tube (see FIGS. 2 and 5). This engagement limits the rotation of the sleeve between a first end position in which the slots 22 on the tube are in registry with the slots 24 on the sleeve to permit material to be dispensed, as illustrated in FIG. 4, and a second end position in which the slots are out of alignment and therefore blocked by overlying or underlying portions of the sleeve or tube, respectively, as illustrated in FIG. 3. A very small sideways turn of the sleeve moves the sleeve back and forth between the fully open and fully blocked positions.

A gripping portion 42, which may be knurled to facilitate handling, is provided adjacent the end of the conical portion of the sleeve to permit the user to easily grip the sleeve for rotation or twisting between the open and closed positions. A similarly knurled portion 44 is provided on the threaded end of tube 12 to allow it to be easily gripped for securing to a container and removal from the container after use.

Operation of the pouring spout illustrated in FIGS. 1 to 5 will now be explained in more detail. The spout is particularly designed for attachment to an oil container to allow controlled dispensing of the oil into an oil fill opening of an engine, for example an automobile, aircraft, or other machinery engine. The sleeve will initially be positioned in the closed position in which the dispensing slots are all blocked. In this position, the container can be completely inverted without spillage, since the parts are designed to be a close, interference fit. The plastics material utilized in molding the parts will have a degree of resilience, inherently producing a relatively good seal between the outer surface of the pouring tube and the inner surface of the closure sleeve, without needing any additional seals. The container is therefore inverted, and the closed end of the assembly is inserted into an oil fill opening. The assembly can be allowed to rest on the oil fill opening since the gradually tapered conical portion will act as a stop or rest for seating on a large range of different diameter oil fill openings.

Once the assembly has been positioned on the oil fill opening, a quick twist or sideways turn of the sleeve into the opposite end position of projection 34 in indent 36 will align the openings to allow dispensing of the oil. Only one hand will be needed, leaving the other hand free for supporting the operator, for example where they need to reach forward over a large engine area in order to reach the oil fill opening. Misalignment or excessive rotation of the closure sleeve will be prevented by the co-operation of projection 34 in indent 36, which both restricts the rotational movement of the sleeve and also prevents relative axial movement between the parts. Once oil delivery is complete, a turn of the sleeve in the opposite direction will close the openings or delivery ports, allowing the dispensing or pouring assembly to be removed from the oil fill spout without dripping of any substantial quantities of oil onto surrounding engine areas, reducing the extent of soiling or contamination.

FIGS. 6 to 9 illustrate a second embodiment of the invention in which a pouring assembly or fitment 50 comprises an inner pouring tube 52 open at both ends 54,56 and having internal screw threads 58 at one end 54 for securing it to a container outlet as in the first embodiment, and an outer closure sleeve 60 fitting over the inner tube 52 for controlling dispensing of material from the tube.

Figure 7:
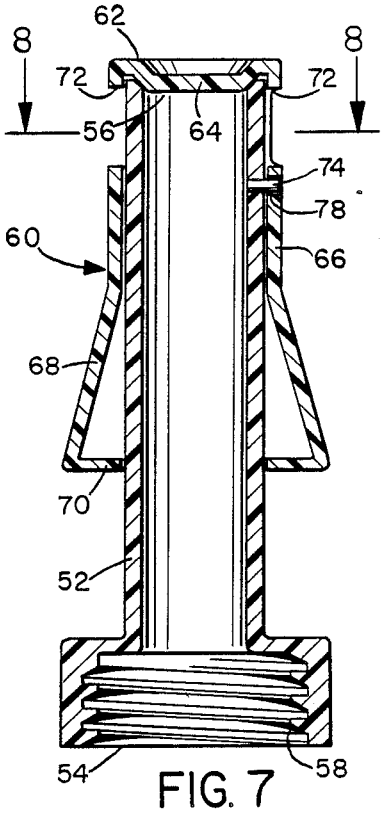
FIG. 7 is a sectional view taken on line 7—7 of FIG. 6.
Figure 8:
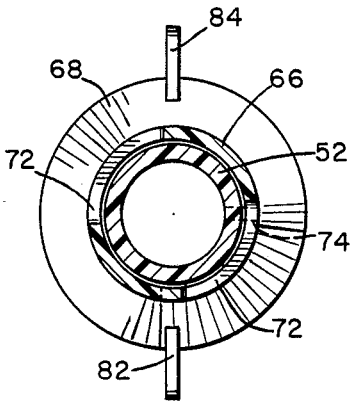
FIG. 8 is a sectional view taken on line 8—8 of FIG. 7.

The outer closure sleeve is closed at one end 62 which engages over the open end 56 of the inner tube in the closed position illustrated in FIG. 7. Preferably, a boss or projection 64 on the inner face of closed end 62 projects into open end 56 to seal the opening in the closed position and prevent or reduce leakage. As in the first embodiment, sleeve 60 has a first, cylindrical portion 66 extending from closed end 62, and a second, outwardly tapering conical portion 68 extending from the cylindrical portion to a second end 70 of the sleeve. At least one dispensing opening 72 is provided on the outer surface of the sleeve 60 adjacent its closed end 62.

Sleeve 60 is movable both rotatably and axially to a limited extent relative to tube 50 by virtue of a projection or button 74 on the outer surface of tube 50 which engages in an elongated, inclined groove or slot 76 on the corresponding inner surface of sleeve 60. It will be understood that projection 74 could alternatively be provided on the inner surface of sleeve 60 with co-operating groove 76 being provided on the outer surface of tube 50. The groove 76 is slanted or inclined relative to the longitudinal axis of the assembly, and at the same time extends around part of the circumference of the tube, so that the keyed engagement between groove 76 and projection 74 guides the sleeve 60 to move axially relative to tube 50 when the sleeve is rotated to move the projection 74 between the opposite ends of groove 76. Groove 76 has opposite end stop portions 78,80 which are inclined relative to the slanted central travel portion into orientations which are substantially perpendicular to the axis of the tube 50 and sleeve 60. This restricts inadvertent axial slipping of sleeve 60 relative to tube 50 when in either of its end positions.

A pair of diametrically opposed gripping ears 82,84 are provided on the open end of sleeve 60 for gripping by a user to easily rotate or twist the sleeve between the open and closed positions. In the closed position illustrated in FIG. 6 and 7, the projection 74 will be located in one end stop portion 78 of the groove 76. In this position, the open, dispensing end 56 of tube 50 is sealed or blocked by boss 64 on the sleeve 60, which projects into the open end of the tube as illustrated in FIG. 7. At the same time, the dispensing opening or openings 72 of sleeve 60 will be blocked by underlying portions of the tube 50.

Figure 6:
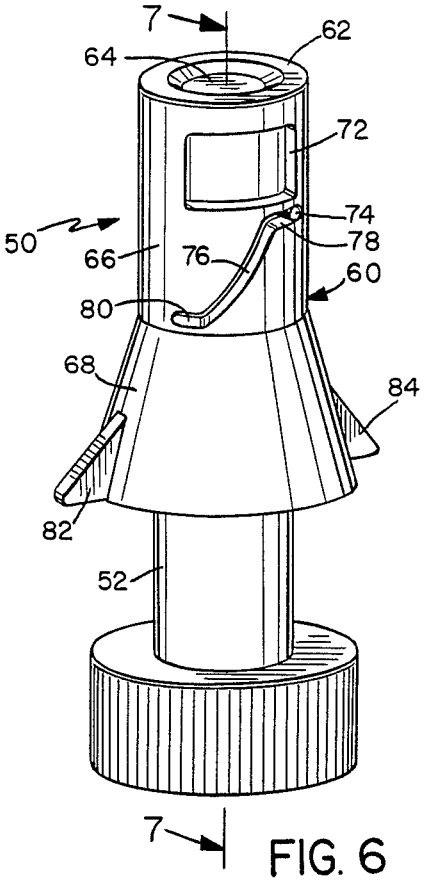
FIG. 6 is a perspective view of an alternative configuration of the spout.
Figure 9:
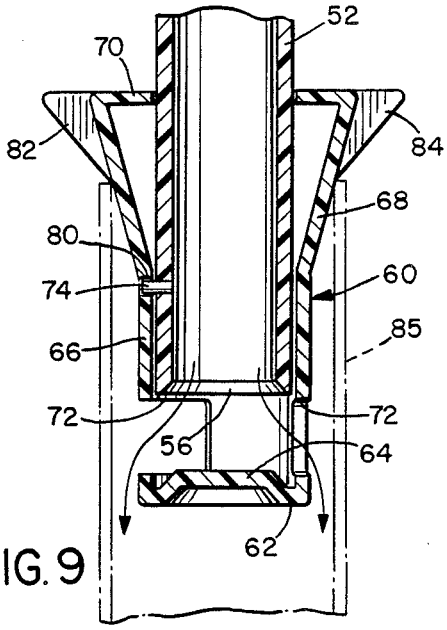
FIG. 9 is a view similar to a portion of FIG. 7, with the spout opened and inverted in a receptacle.

When the user wishes to dispense material from the assembly, for example when the spout has been inverted and positioned in an oil fill opening 85 with the conical portion of the sleeve resting on the rim of the opening, as illustrated in FIG. 9, the sleeve is twisted in an anticlockwise direction from the position illustrated in FIG. 6. The engagement of projection 78 in groove 76, which acts as a key or guide for the projection 78, forces the sleeve simultaneously to move axially outwardly into the open position illustrated in FIG. 9, at which point the projection 78 rests in stop portion 80 of the groove. In this position the boss 64 is spaced away from the open, dispensing end of tube 50, allowing material to be dispensed from the tube into the space between the tube and closed end of the sleeve, while the dispensing openings 72 on sleeve 60 are spaced above tube 50, allowing the material to flow outwardly through openings 56 and 64 as indicated by the arrows in FIG. 9. The sleeve will be held in the open position against axial movement relative to the tube by the engagement of projection 74 in stop portion 80 of the groove, until the sleeve is positively twisted away from this position by the user.

Once dispensing is complete, the user gives a quick twist of the sleeve in the opposite, clockwise direction, which forces the sleeve to move axially inwardly as it turns due to the travel of projection 74 along groove 76. The sleeve will move back into the closed position, sealing the open end of tube 50 and simultaneously closing the dispensing opening 72. The container and spout can then be removed from the oil fill opening without risk of spilling substantial quantities of oil. More openings 72 may be provided at spaced intervals around the end portion 66 of sleeve 60 if desired.

The pouring spout in the second embodiment of the invention is also of a molded plastics material and is designed to be relatively easy and inexpensive to manufacture. The pouring spout is inexpensive enough to be supplied as a disposable attachment to a container such as a bottle of engine oil, or as a reusable attachment which can be detachably secured to a container when dispensing material and then removed for subsequent use on a new container. Due to the axial movement of the closure sleeve on rotation, the flow out of the spout when in its open position is substantially unrestricted and does not depend on the overlap between opposing openings in the sleeve and tube, avoiding any possibility of misalignment problems.

Although the assembly is releasably mountable on the container in both of the illustrated embodiments, the inner, pouring tube may alternatively be permanently secured to the container as a disposable part of any dispensing container.

Although some preferred embodiments of the invention have been described above by way of example only, it will be understood by those skilled in the field that modifications may be made to the disclosed embodiments without departing from the scope of the invention, which is defined by the appended claims.

I claim:

1. A pouring assembly for controlling pouring of material from a container in an inverted position, the assembly comprising:

an elongate, tubular pouring member having a first end for attachment to the mouth of a container and a second, opposite end having dispensing means for dispensing material from the pouring member; and a closure sleeve member for fitting over the second end of the pouring member to control dispensing of material from the pouring assembly, the closure sleeve member having a first, closed end for engagement with said second end of said pouring member, a first, generally cylindrical portion extending from said closed end and having a close fit on said pouring member, and a second, flared conical portion extending from said cylindrical portion to a second end of said sleeve member, said conical portion having a continuous, gradual outward taper from said cylindrical portion to said second end of said sleeve member;

said closure sleeve member having slot means for allowing material dispensed from said pouring member to be dispensed outwardly from said sleeve member, said sleeve member being movable relative to said pouring member between a first, closed position in which said dispensing means and slot means are blocked to prevent dispensing of material from said assembly and a second, open position in which said dispensing means and slot means are open to allow material to be dispensed; and said closure sleeve member having gripping means at its second end for gripping by a user to move said sleeve member between said two positions.

2. The assembly as claimed in claim 1, wherein said pouring member and said closure sleeve members have interengageable guide formations on their outer and inner faces, respectively, comprising means for restricting movement of said sleeve member relative to said pouring member between said two positions.

3. The assembly as claimed in claim 2, wherein said guide formations comprise an elongate groove on one of said members and a projection on the other member positioned for sliding engagement in said groove.

4. The assembly as claimed in claim 3, wherein said groove extends around part of the periphery of one of said members in a direction transverse to the longitudinal axis of said assembly to restrict relative axial movement between said members and to allow said closure sleeve member to be rotated between said first and second positions.

5. The assembly as claimed in claim 3, wherein said groove extends around part of the periphery of one of said members and is inclined at an acute angle to the longitudinal axis of said assembly along at least part of its length to guide said sleeve member to move axially a predetermined distance relative to said pouring member when rotated, said sleeve member being positioned with its first end spaced axially outwardly from said second end of said pouring member in said second position.

6. The assembly as claimed in claim 5, wherein said groove has end stop portions at its opposite ends corresponding to said first and second positions of said sleeve member, each end stop portion being substantially perpendicular to the longitudinal axis of the assembly to restrict axial movement of said sleeve member in each of its end positions.

7. The assembly as claimed in claim 1, including guide means between said members for guiding movement of said sleeve member between said first and second positions, said guide means comprising means for allowing said sleeve member to rotate a predetermined distance relative to said pouring member and for preventing relative axial movement between said members, said dispensing means on said pouring member comprising a plurality of ports at equal spacings around said second end of said pouring member, and said slot means on said sleeve member comprising an equal number of ports at equivalent spacings around said sleeve member for registering with said ports on said pouring member in said first, open position of said closure sleeve member.

8. The assembly as claimed in claim 1, including guide means between said members for guiding said sleeve member to move axially relative to said pouring member on twisting of said sleeve member relative to said pouring member so that said first end of said sleeve member is spaced axially outwardly from the second end of said pouring member in said second position.

9. The assembly as claimed in claim 8, wherein said dispensing means on said pouring member comprises an axial opening in said second end of said pouring member, and said slot means on said sleeve member comprises at least one port positioned in a portion of said sleeve member which projects outwardly from said pouring member in said second position.

10. The assembly as claimed in claim 9, wherein said sleeve member includes seal means on the inner side of its first end for sealing engagement with said axial opening in the second end of said pouring member in said first position.

11. A pouring assembly for controlling pouring of material from a container in an inverted position, the assembly comprising:

an elongate pouring tube member open at its opposite ends, the first end having means for attachment to the mouth of a container and the second, opposite end comprising means for dispensing material from the tube member;

a closure sleeve member for fitting over the second end of the tube to control dispensing of material from the tube;

guide means between said closure sleeve member and tube member for controlling movement of said sleeve member rotatably and axially relative to said tube member between a first position in which said second end of said tube member is blocked and a second position spaced axially outwardly from said first position in which said second end of said tube member is open, said sleeve member having at least one dispensing opening for dispensing material discharged from the second end of said tube member in said second position;

said closure sleeve member having gripping means for gripping by a user to move said sleeve member back and forth between said two positions; and said sleeve member has a first, closed end for blocking the second end of said tube member in said first position, a cylindrical portion extending from said first end for fitting over part of the length of the tube member, and an outwardly flared conical portion tapering gradually from said cylindrical portion to the opposite, second end of said sleeve member.

12. The assembly as claimed in claim 11, wherein said dispensing opening is provided in said cylindrical portion of said sleeve member.

13. The assembly as claimed in claim 11, wherein said guide means comprises an elongate slot on one of said members and a projection for guided engagement in said slot on the other member, said slot extending at an acute angle to the longitudinal axis of said assembly to move said sleeve member axially relative to said tube member when said sleeve is rotated.

14. A pouring assembly, comprising:

a container for holding material to be dispensed, said container having an open end;

an elongate pouring tube having a first end attached to the open end of the container and a second end having at least one dispensing opening for dispensing material from the container in an inverted position; and a closure sleeve fitting over said tube and movable relative to the tube between a first position in which said dispensing opening is blocked and a second position in which said dispensing opening is open to allow material to be dispensed, said closure sleeve having a first, closed end for engagement with the second end of said tube, a cylindrical portion extending from said first end for closely fitting over said tube, and an outwardly flared conical portion extending from said cylindrical portion to a second end of said sleeve, said conical portion having a continuous, gradual outward taper from said cylindrical portion to the second end of said sleeve;

said conical portion of said closure sleeve having a gripping portion adjacent said second end for gripping by a user to move said sleeve between its two positions relative to said pouring tube.

* * * * *